US007430952B2

(12) United States Patent
Laubie

(10) Patent No.: US 7,430,952 B2
(45) Date of Patent: Oct. 7, 2008

(54) PROTECTIVE DEVICE FOR THE CONFINEMENT OF EXPLOSIVE OBJECTS OR OBJECTS SUSPECTED TO BE SUCH

(75) Inventor: Charles Laubie, Paris (FR)

(73) Assignee: Sema, Nenterre (FR)

( * ) Notice: Subject to any disclaimer, the term of this patent is extended or adjusted under 35 U.S.C. 154(b) by 414 days.

(21) Appl. No.: 10/519,277

(22) PCT Filed: Jun. 25, 2002

(86) PCT No.: PCT/FR02/02199

§ 371 (c)(1),
(2), (4) Date: Aug. 22, 2005

(87) PCT Pub. No.: WO04/001329

PCT Pub. Date: Dec. 31, 2003

(65) Prior Publication Data

US 2006/0096451 A1 May 11, 2006

(51) Int. Cl.
*F42B 33/00* (2006.01)
*F41H 5/00* (2006.01)

(52) U.S. Cl. ..... 86/50; 89/36.01; 89/36.07; 89/36.02

(58) Field of Classification Search ..... 89/36.01, 89/36.07, 36.02; 86/50
See application file for complete search history.

(56) References Cited

U.S. PATENT DOCUMENTS 3,814,016 A 6/1974 Leach et al.
5,044,252 A 9/1991 Gamadi et al.
6,865,977 B1 * 3/2005 Kim et al. ..... 86/50
7,219,588 B2 * 5/2007 Pastrnak et al. ..... 86/50

FOREIGN PATENT DOCUMENTS

| | | |
|---|---|---|
| DE | 9203603 | 7/1992 |
| DE | 301786 | 1/1994 |
| DE | 19717474 | 10/1998 |
| EP | 0511182 | 10/1992 |
| EP | 1229298 | 8/2002 |
| FR | 1245592 | 2/1961 |
| FR | 2271929 | 12/1975 |
| FR | 2428721 | 1/1980 |

(Continued)

OTHER PUBLICATIONS

International Search Report for PCT/FR 02/02199, mailed Feb. 26, 2003 (2 pages).

(Continued)

*Primary Examiner*—John W Eldred
(74) *Attorney, Agent, or Firm*—Meyertons, Hood, Kivlin, Kowert & Goetzel, P.C.; Eric B. Meyertons

(57) ABSTRACT

In various embodiments, explosive objects or objects suspected of being explosive may be substantially contained. A protective device for the confinement of explosive objects or objects suspected to of being explosive may include a sleeve. The axial ends of the sleeve may be open. The sleeve may include a layer of blasting-mat material, splinter-proof material, and/or fire-resistant material. The sleeve may be designed to be placed in a position and remain upright to substantially enclose a suspect object resting on a surface.

10 Claims, 3 Drawing Sheets

FOREIGN PATENT DOCUMENTS

| | | |
|---|---|---|
| FR | 2608268 | 6/1988 |
| FR | 2774161 | 7/1999 |
| GB | 1459743 | 12/1976 |
| GB | 1467470 | 3/1977 |
| GB | 2041178 | 9/1980 |
| GB | 2331241 | 5/1999 |
| RU | 2116613 | 7/1998 |
| RU | 2150669 | 6/2000 |
| WO | 9607073 | 3/1996 |
| WO | 9844309 | 10/1998 |
| WO | 9931457 | 6/1999 |
| WO | 03067178 | 8/2003 |

OTHER PUBLICATIONS

International Search Report for PCT/FR 03/00265 mailed on Jun. 30, 2003 (3 pages).
International Seach Report for PCT/FR 02/00463 mailed on Jul. 12, 2002 (3 pages).
International Search Report for PCT/FR 02/04571 (2 pages).

* cited by examiner

PROTECTIVE DEVICE FOR THE CONFINEMENT OF EXPLOSIVE OBJECTS OR OBJECTS SUSPECTED TO BE SUCH

BACKGROUND OF THE INVENTION

1. Field of the Invention

The present invention relates to a protective device for the confinement of explosive objects and/or objects suspected of being explosive.

2. Description of the Relevant Art

When an abandoned object is discovered, especially in a public place, the precautionary course of action is to avoid touching it or displacing it and to evacuate people situated all around. Due to the risk of imminent explosion of a suspect object, an attempt is made to confine the suspect object in order to mitigate the effects of a possible explosion. Consideration may be given to covering over the suspect object with a splinter-proof protective cover or hiding the object behind a splinter-proof protective screen.

When an explosive device explodes, blast effects are propagated in all directions, generating considerable forces upon the obstacles which the blast effects encounter. Splinters are also projected in all directions. When a splinter-proof protective cover is used the protected cover is lifted up by the explosion so that it prevents the upward projection of splinters without effectively protecting a horizontal zone surrounding the explosive device or preventing the propagation of the blast effects. Moreover, an explosive device surrounded by a cover is rendered completely invisible, and so bomb disposal experts who examine the device may have certain apprehension as they free the device in order to examine it, which adds to the experts' stress. Screens only protect a single side of the explosive device. Upon the explosion, there is a risk that the screen will be blasted by the explosion and topple over backward, where it no longer fulfils its protective function.

SUMMARY

Herein we describe protective device for the confinement of explosive objects or objects suspected of being explosive. A protective device may allows effective protection against possible explosion of an object by preventing the propagation of splinters and blast effects. In some embodiments, a protective device may be easily used without touching a suspect object. A protective device may allows easy access to the suspect object for bomb disposal experts and provide improved protection for bomb disposal experts.

A protective device may substantially confine explosive objects or suspected explosive objects. In some embodiments, a protective device may include a sleeve. A sleeve may be open at its axial ends. A sleeve may include at least one layer of fabric. Fabrics for a sleeve may include a splinter-proof type of fabric. A sleeve may be positioned on a surface by one of its ends. A sleeve may be positionable substantially vertically to a surface so that the sleeve surrounds a suspect object resting on the surface.

When an explosive device placed on a surface explodes, blast effects and splinters are propagated in all directions, especially in horizontal and vertical directions. Some splinters and blast effects are propagated upward. Some splinters and blast effects propagate downward and are reflected by the ground. Protection of people proximate the explosive device may be principally by inhibiting the propagation of splinters and blast effects in a horizontal direction.

In some embodiment, a sleeve may be positioned vertically and/or surround the object without substantially contacting it.

The open-ended sleeve may be a simple and highly resistant structure when faced with outwardly-directed, radial forces applied to the inner wall and so the sleeve may substantially contain the splinters and the blast effects which propagating radially and/or substantially horizontally. The surrounds of the explosive object may be protected by a sleeve.

In some embodiments, a sleeve may include an opening on a top surface. An opening on a top surface of a sleeve may allow upward propagation of blast effects and splinter, and may allow an evacuation of the energy of the explosion in a direction which presents no danger to people situated in a zone surrounding the explosive object. Energy from blast effects and splinters propagating downward may be at least partially absorbed as the blast effects and splinters are reflected from the ground. An open-ended sleeve may provide bomb disposal experts a view of and access to the object through the top of the sleeve while protecting the experts from the horizontal propagation of splinters and blast effects.

In some embodiments, a sleeve may include at least one splinter-proof ring. A splinter-proof ring may include several thicknesses of splinter-proof fabric. A sleeve may include a plurality of concentric, splinter-proof rings to increase the protection offered by the sleeve. In one embodiment, a splinter-proof ring may be formed by winding splinter-proof fabric. A splinter-proof ring may include at least one axial fastening and reinforcing seam. Axial fastening and reinforcing seam may keep a splinter-proof ring wound. Fastening and reinforcing seams locally may increase the rigidity of the splinter-proof type fabric used to improve the rigidity of the splinter-proof ring and may facilitate holding the sleeve in the vertical position. A splinter-proof ring may include a plurality of axial seams to increase the resistance and/or strength of the ring.

In some embodiments, a sleeve may include a reinforcing ring including at least one layer of material with a rigidity sufficient to hold the sleeve substantially upright when it is placed in position. A plastics material, for example, may be used and is light which may make the sleeve easier to handle.

In one embodiment, a sleeve may include at least one reinforcing web which may substantially surround the sleeve. A reinforcing web may increase the resistance of the sleeve to the internal forces directed radially outward and generated by the blast effects of an explosion. To prevent a sleeve from raising during an explosion and causing a gap to form between the ground and a bottom end of the sleeve, the device may, in one embodiment, include a first sleeve and a second sleeve that substantially surrounds the first sleeve. A second sleeve may be slidable relative to a first sleeve. In one embodiment, first and second sleeves may be coupled with an expansion joint.

In some embodiments, to prevent the protective rings from damaged from flames created by an incendiary explosive device, the protective device may include an inner protective layer that is fire-resistant. A fire-resistant lining can be of the type comprising aluminum. For example, a fire-resistant lining can be provided in the form of a fireproofing fabric forming an inner wall of an outer casing of the sleeve.

BRIEF DESCRIPTION OF THE DRAWINGS

Features and advantages of the methods and apparatus of the present invention will be more fully appreciated by reference to the following detailed description of presently preferred but nonetheless illustrative embodiments in accordance with the present invention when taken in conjunction with the accompanying drawings in which.

Figure 1:
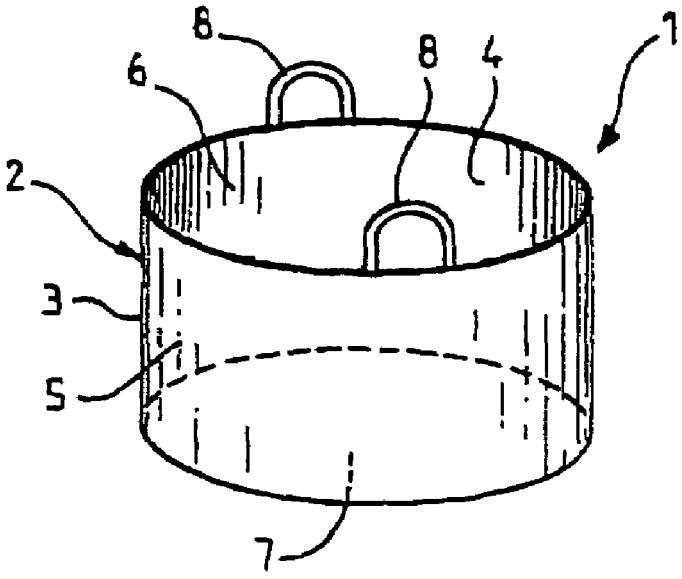
FIG. 1 is a perspective view of an embodiment of a protective device according to the invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF EMBODIMENTS

FIG. 1 depicts an embodiment of a protective device capable of substantially confining explosive objects or objects suspected of being such. A protective device 1 may include a multilayered sleeve 2. A sleeve 2 may include an outer casing 3 with an inner wall 4 and an outer surface 5. The sleeve 2 may include openings 6, 7 proximate its axial ends. Handles 8, may be coupled on a top edge of the sleeve 2. In an embodiment, a sleeve may include two handles.

In some embodiments, a multilayered sleeve 2 may include concentric layers or rings positioned in the casing 3. The sleeve 2 may include splinter-proof rings and/or reinforcing rings. Splinter-proof rings may inhibit propagation of splinters and blast effects.

Figure 2:
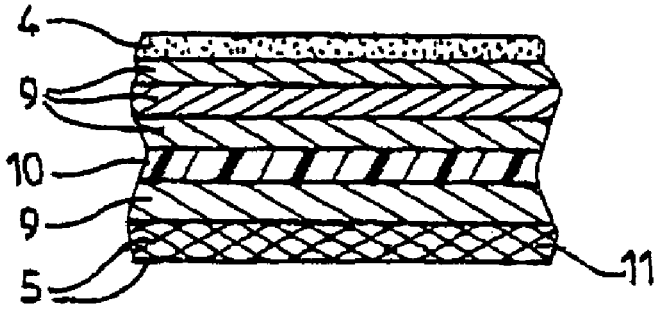
FIG. 2 is a sectional view of an angular portion of an embodiment of a protective device.

FIG. 2 depicts a sectional view of an angular portion of an embodiment of a sleeve 2 which allows the multilayered assembly of the sleeve 2 to be better visualized. The concentric layers are described successively from the inside of the sleeve 2 outward. The first layer may include an inner wall 4 of the casing 3. An inner wall may be made of fireproofing fabric. An inner wall may include an aluminum-type fireproofing liner. Next, the sleeve 2 may include three protective rings 9 positioned concentrically in the casing 3. Protective rings may be made of splinter-proof materials. In an embodiment a protective ring may be made of the type of material used in bullet-proof vests. Next, the sleeve may include a reinforcing ring 10, another protective ring 9, and an outer layer 11. A reinforcing ring may be made of semi-rigid plastics material. An outer layer 11 may form the casing 3 with the inner wall 4 and may have an outer surface 5. The outer layer 11 may be made of any type of material or fabric.

Figure 3:
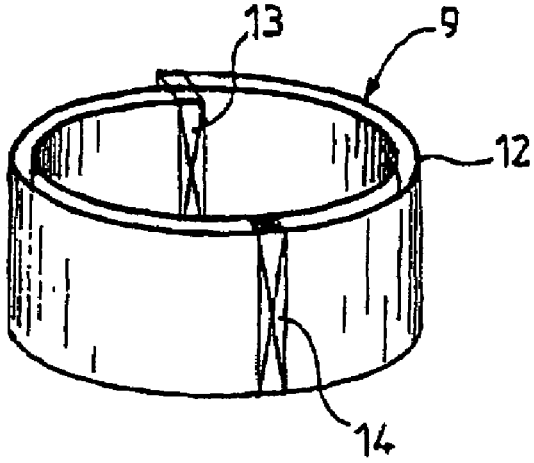
FIG. 3 is a perspective view of an embodiment of a winding designed to form a protective ring.

As depicted in FIG. 3, a protective ring 9 may be formed by winding a strip of splinter-proof fabric 12 to obtain a multilayered protective ring 9. A multilayered protected ring 9 may include two layers. In some embodiments, an axial fixing and a reinforcing seam 13 may keep the strip of splinter-proof fabric 12 substantially wound. A reinforcing seam 13 may pass through the different layers of splinter-proof fabric in order to couple the ends of the strips of splinter-proof fabric 11 which are positioned radially facing one another. A second fastening and reinforcing seam 14 may be positioned diametrically opposed to the first seam 12. A second fastening and reinforcing seam 14 may improve the fastening and the reinforcement of the protective ring 9. In some embodiments, a protective ring 9 may include any number of layers. A number of layers used to form a protective ring may be selected based at least partially on the protection desired. In an embodiment, just one thick protective ring may be used. If a sleeve 2 has sufficient strength to be held vertically when positioned on one of its axial ends, a reinforcing ring 10 in the thickness of the sleeve 2 may not be used.

Figure 4:
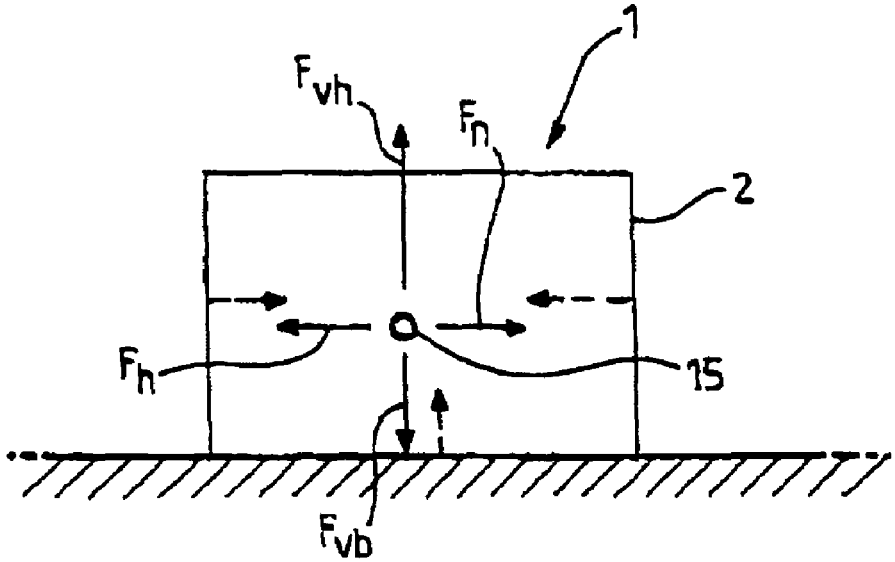
FIG. 4 is a diagrammatic sectional view of the embodiment of the protective device shown in FIG. 1 that illustrates the phenomena which may occur with the explosion of an explosive device.

When an explosive object or device or one suspected of being such is discovered on a surface, urgent action may be taken to evacuate a security zone and to confine the object as quickly as possible with the aid of the sleeve 2. It may be desirable not to touch the object while placing the sleeve around the object. FIG. 4 depicts a sleeve 2 placed on the ground surrounding an explosive object symbolized by a circle 15. Upon explosion of the explosive object 15, blast effects may be propagated in various directions, generating considerable forces on the obstacles it encounters. Splinters also may be projected in various directions.

As depicted in FIG. 4, blast effects are symbolized by arrows representing generated forces. For the sake of simplification, the forces may be split in the vertical and horizontal directions. The forces directed vertically upward are symbolized in FIG. 4 by an arrow Fvh, the forces directed vertically downward are symbolized by an arrow Fvb, and the forces directed horizontally are symbolized by the arrows FH. When one of the forces encounters an obstacle, it may push the obstacle back until the resistance of the obstacle is greater than this force and so an opposite reactive force is then created. Each reflection of the blast effect partially absorbs the energy of the explosion. The reflected forces symbolized by dotted arrows in FIG. 4. When an object 15 is placed on the ground, the downwardly directed forces Fvb may be reflected by the ground, which offers considerable resistance. The upwardly directed forces Fvh may escape freely through the top opening 6 made in the sleeve 2.

Horizontal forces FH from an explosion may be propagated radially in a substantially symmetrical manner and strike the inner wall 4 of the sleeve 2. The sleeve 2 may be composed of fabrics and/or a semi rigid reinforcing ring. The sleeve 2 may have a substantially oval, elliptical, or cylindrical shape, which may allow the sleeve 2 to effectively resist radial forces. A semi-rigid sleeve may deform under the blast of the explosion to better to resist the internal forces exerted by the horizontal forces FH. The protective rings may be designed to resist these considerable forces. The sleeve 2 may substantially contain the blast effects and the splinters. Consequently, the horizontal forces FH may be reflected inward and partially absorbed. The successive reflections of the horizontal forces FH inside the sleeve 2 may allow the energy of horizontal propagation created by the explosion to be at least partially absorbed and dissipated. The upwardly directed vertical forces, FVh, and/or the downwardly directed vertical forces, Fvb, reflected by the ground may escape freely through the top opening 6 formed in the sleeve 2.

Figure 5:
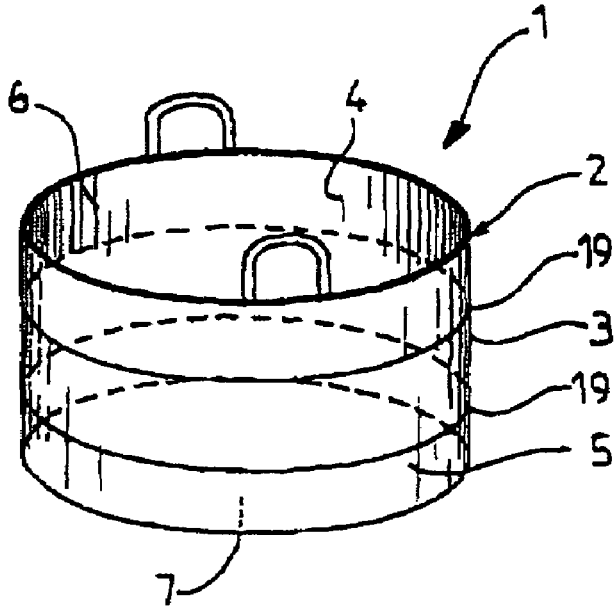
FIG. 5 is a perspective view of a variant of the embodiment of the protective device shown in FIG. 1.

In some embodiments, a protective device for the confinement of explosive objects or objects suspected of being explosive may be used inside or outside buildings. The protective device may use the resistance of the ground or floor to dissipate a part of the energy produced by the explosion. As depicted in FIG. 5, a sleeve 2 may include webs 19 surrounding the sleeve 2. Webs 19 may improve the mechanical resistance of the sleeve and may improve the ability of the sleeve to contain the blast effects of an explosion.

Figure 6:
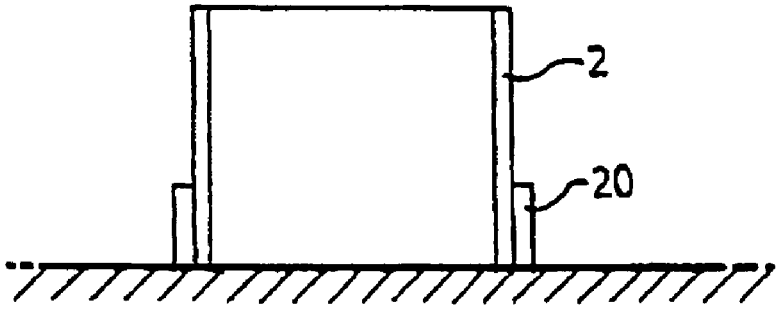
FIG. 6 is a sectional view of a second variant of the embodiment of the device shown in FIG. 1.

In some embodiments, a protective device 1 may include a first sleeve 2 and a second sleeve 20, as depicted in FIG. 6. A second sleeve may be shorter than the first sleeve 2. A second sleeve may substantially surround a bottom end of the first sleeve 2. The second sleeve 20 may be configured to slide axially relative to the first sleeve 2. The second sleeve 20 may have a composition similar to the first sleeve 2. In an embodiment, a second sleeve may include protective rings (not represented in FIG. 6).

Figure 7:
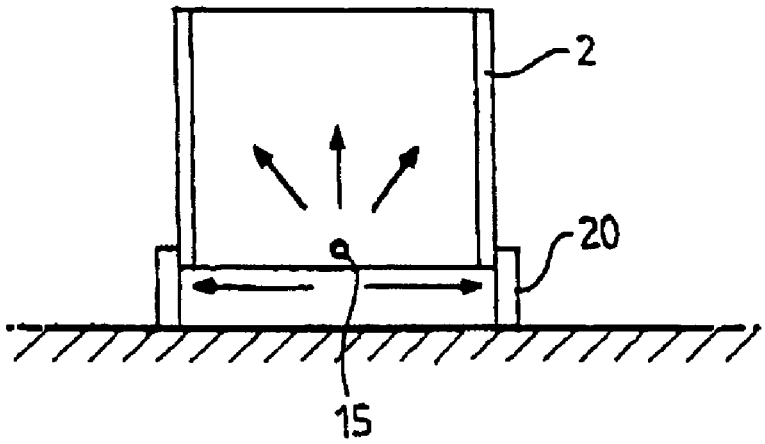
FIG. 7 is a sectional view of the embodiment of the device shown in FIG. 6 at the time of an explosion.

As illustrated in FIG. 7, in an explosion the sleeve 2 may be raised by vertical forces acting on the inner wall 4 of the first sleeve 2 and/or due to reaction forces from downwardly directed vertical forces. When an explosion at least partially raises a sleeve, there may be a risk of blast effects propagating between a bottom edge of the first sleeve 2 and the ground. Splinters also may project horizontally and pass through this space. When the first sleeve is at least partially raised, the second sleeve 20, being slidable relative to the first sleeve 2 and not having suffered the direct influence of the explosion, may remain in contact with the ground. The second sleeve 20 may prevent the horizontal propagation of blast effects and projected splinters.

Figure 8:
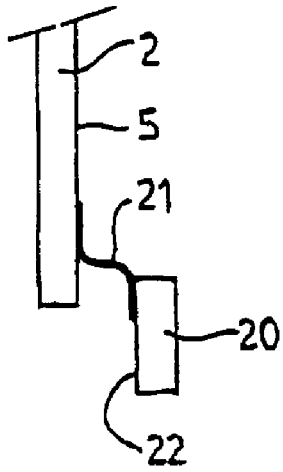
FIG. 8 is a detailed view of the embodiment of the device shown in FIG. 7.

As depicted in FIG. 8, an expansion joint 21 may couple the bottom edge of the first sleeve 2 and the top edge of the second sleeve 20. The expansion joint 21 may include, but is not limited to, an annular skirt or a plurality of tongues. An expansion joint 21 may include a hem stitched on the outer surface 5 of the first sleeve 2 and an opposite hem stitched on an inner wall 22 of the second sleeve 20. In an embodiment, an expansion joint 21 may have a length such that when the first sleeve is displaced relative to the second sleeve to the point of stretching the expansion joint 21, a covering over of the first sleeve 2 by the second sleeve 20 is maintained to prevent the formation of a gap.

Sleeves 2 may have different sizes according to the size of the explosive device to be confine. In some embodiments, it may be desirable to confine an explosive device using different-sized sleeves, which may be positioned successively in a concentric manner to form a plurality of protective barriers to inhibit a horizontal propagation of blast effects and splinters even if a central sleeve is slightly raised at the moment of the explosion.

In some embodiments, a sleeve 2 surrounding the explosive device at the moment of its explosion may inhibit a horizontal propagation of the splinters while allowing the splinters to be propagated upward or strike the ground. The forces created by blast effects and splinters propagating vertically may contact either the ground, the floor, or the ceiling, which are generally resistant structures that may withstand the blast effects and the splinters without major damage. In addition, the sleeve may substantially contain and/or dissipate the horizontal blast effects, as well as the horizontally projected splinters. The sleeve may increase protection in the horizontal direction in order to protect the people and installations situated around the explosive device.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

The invention claimed is:

1. A protective device for the confinement of explosive objects or objects suspected of being explosive comprising:

a first sleeve and a second sleeve, wherein the second sleeve substantially surrounds the first sleeve, and wherein the second sleeve is configured to be slidable relative to the first sleeve, wherein the first sleeve and the second sleeve are coupled with an expansion joint; wherein at least one of the first or the second sleeve comprises:

at least one opening at each axial end of the sleeve;

at least one layer of splinter-proof fabric; and wherein one end of the sleeve is configured to be positioned on a surface, and wherein the sleeve is configured to remain substantially vertically, and wherein the sleeve is configured to substantially surround a suspect object resting on the surface.

2. The device of claim 1, wherein the first and/or second sleeve comprise one or more protective rings, wherein the protective rings comprise one or more layers of splinter-proof fabric.

3. The device of claim 2, wherein a protective ring composed of:

a wound strip of splinter-proof fabric, the ends of which are coupled together by at least one reinforcing seam.

4. The device of claim 2, wherein the first and/or second sleeve comprise one or more reinforcing rings, wherein the reinforcing rings comprise one or more layers of material possessing a rigidity sufficient to hold the first and/or second sleeve in a vertical position.

5. The device of claim 1, wherein the first and/or second sleeve comprises at least one reinforcing web, wherein the reinforcing web substantially surrounds the first and/or second sleeve.

6. The device of claim 1, further comprising an inner protective layer, wherein the inner protective layer is fire-resistant.

7. The device of claim 2, wherein the first and/or second sleeve further comprises at least one reinforcing web, wherein the reinforcing web substantially surrounds the first and/or second sleeve.

8. The device of claim 1, wherein the expansion joint includes an annular skirt or a plurality of tongues.

9. The device of claim 1, wherein the second sleeve is shorter than the first sleeve.

10. The device of claim 1, wherein the expansion joint have a length such that, when the expansion joint is stretched, a covering over the first sleeve by the second sleeve is maintained.

* * * * *